US006516904B1

(12) United States Patent
Rein, Sr. et al.

(10) Patent No.: US 6,516,904 B1
(45) Date of Patent: Feb. 11, 2003

(54) MINING DRILL STEELS AND METHODS OF MAKING THE SAME

(75) Inventors: Terry L. Rein, Sr., Verounville, WV (US); Terry L. Rein, Jr., Verounville, WV (US)

(73) Assignee: American Mine Services, Man, WV (US)

( * ) Notice: Subject to any disclaimer, the term of this patent is extended or adjusted under 35 U.S.C. 154(b) by 0 days.

(21) Appl. No.: 08/917,623

(22) Filed: Jul. 23, 1997

(51) Int. Cl.[7] ..... E21B 17/00
(52) U.S. Cl. ..... 175/320; 403/383
(58) Field of Search ..... 175/320; 403/359.6, 403/305

(56) References Cited

U.S. PATENT DOCUMENTS 4,226,290 A * 10/1980 McSweeney ..... 175/320
4,474,488 A * 10/1984 Pinkerton et al. ..... 403/24
5,337,842 A * 8/1994 Robinson ..... 175/323
5,599,129 A * 2/1997 Clifton et al. ..... 403/2
6,189,632 B1 * 2/2001 Warden ..... 175/320

OTHER PUBLICATIONS

Long–Airdox publication, "Drill Steels and Augers", date unknown.*

* cited by examiner

*Primary Examiner*—William Neuder
(74) *Attorney, Agent, or Firm*—Steptoe & Johnson PLLC

(57) ABSTRACT

To eliminate or reduce the possibility of fracture in drill steels used in the roof bolting operations in mines the square or hexagonal surfaces of such drill steels or the elements such as couplings or collars which are to be connected to them are machined rather than forged.

13 Claims, 1 Drawing Sheet

MINING DRILL STEELS AND METHODS OF MAKING THE SAME

This invention relates generally to alloy steels used in drilling operations more specifically it relates to steel drills normally used for roof drilling operations.

BACKGROUND OF THE INVENTION

For a number of years mining, particularly coal mining, has been carried out by securing protective plates to the roof of a mine shaft as it is advanced through the earth. Such plates protect the shaft and most importantly protect the miners against a collapse of, or falling of debris from, the roof of the shaft. To secure the plates to the mine roof holes are drilled in the roof and the protective plate are secured by bolts anchored in the roof either by being embedded in resin forced into a hole drilled in the roof or by a bolt which is expanded to grip in the hole.

U.S. Pat. No. 4,226,290 to L. H. McSweeney in its' drawings and text provides a detailed explanation of the devices and technique of "roof drilling" in coal mines and reference is made to that patent for a more complete explanation.

It should not be surprising that coal as a fuel must compete with other sources of energy such as gas and oil and that coal from one mine must compete with coal from competitive mines. Therefore the time required to advance and secure a mine shaft and the costs of materials used to secure that shaft are cost factors which, when reduced, can save measurable amounts and thereby enhance competitiveness.

To speed up the time required to drill the holes for attachment of the protective plates for some time the industry has used bits, called "dust hogs" by some, provided with openings into which the dust or cuttings produced by the bit as the drill advances may enter. Connected to the bit is a length or lengths of drill steel formed as hollow tubes of a suitable steel material. That tube, or varying lengths of it, are connected ultimately to the rotating chuck of a drill motor. The chuck itself is connected to a vacuum to draw the dust from the dust hog through the drill tubes into a collector. In this way the air in the mine is kept relatively free of dust thus helping to maintain the health of the miners and to lessen the chances of an explosive mixture in the air.

As explained in U.S. Pat. No. , 4,226,290 the drill steels have different functions are assigned different tasks. Thus, a finisher is a rod having two hexagonal ends with one end engaging the drill bit while the other end fits into the female end of another length of drill steel called a pusher. The pusher or another piece called a starter may be engaged at one end in a drive system and has a squared end or hands off hexagonal end for that purpose. Various couplings and collars may be used and assembled by press filling on the ends of the steels.

In the prior art known to us the hollow tubes, known as "drill steels" have been formed with flat surfaces, either square or hexagonal, at their ends. These surfaces may be formed on the external surface of the tube or the internal surface and are used to connect one tube to another or to a drill chuck or to the bit.

To our knowledge these drill steels have been formed as original equipment by forging the internal or external flat surfaces. That process has the adverse effect of causing a stressed, weakened portion to be created along the length of the drill steel following the forged surface. Subsequent heat treating does not remove that stressed and weakened area.

Consequently during the use of drill steel it may fracture. Such a fracture gives rise to several problems.

The first of these is the great potential of injury to the miners operating the equipment or in its vicinity. Thus, the situation at the time of such a fracture may involve lengths of hollow steel rods extending vertically and pressed upwardly and subjected to rotating forces and upward pressure and perhaps 10 feet in length. Consequently a fracture of one section could cause a number of flying steel projectiles capable of causing injury.

Another problem is the cost of time and energy to replace the fractured piece in order that the work may continue.

Still a third problem is the uncertainty as to when the fracture will occur. This uncertainty exists because it may occur in a relatively short time after the drill steel is put into use or it may occur at any time and therefore all precautions taken for safety or other reasons must be available at all times.

Because such fractures are relatively common to reduce the costs associated with this operation it has been the practice to repair the drill steels once fractured. This is done by cutting the steel to provide a clean smooth end and welding a new socket or flat surface shank on the now shortened length of drill steel. Apart from the time required for and expense of this process the problem of the stressed portion following the now welded piece is created again because of the heat required for the welding operation and the possibility of new fractures, with all of the previous problems, still exists.

As pointed out above varying lengths of the hollow pieces of drill steel are connected one to the other to provide the necessary driving connection between the drill steel chuck and the dust hog. The bitings and collected dust from the dust hog are drawn through the lengths of drill passing from one to the other until they are deposited in a collector. In the prior art where these lengths are connected to one another or the couplers, adapters, sockets or shanks the ends of the various pieces are formed with flat surfaces. It is possible to have a build up of the collected material at these surfaces perhaps causing a total stoppage of flow causing a narrowing flow area decreasing the efficiency of the system. This too can lead to a halt in the work adding to the costs of the operation.

Therefore it is an object of the invention to provide a novel process for the manufacture of drill steels which does not result in a diminished strength area anywhere along the length of such an article.

It is another object of this invention to provide a novel drill steel capable of being used for extended periods with less concern for failure than heretofore possible.

A still further object of this invention is to provide a novel process for the manufacture of drill steels which is economical and relatively fast thus reducing the costs of such manufacture.

Another object of this invention is to provide a novel drill steel wherein the possibility of stoppage of flowing material within the drills steel is reduced.

SUMMARY OF THE INVENTION

The foregoing and other objects of the invention are achieved by removing metal from the exterior or interior, as the case may be, of the hollow drill steel to form the required flat coupling or engaging surfaces. In a preferred embodiment this is accomplished by machining the surfaces.

In another aspect of the invention a smoother flow of material in the drill steel is provided by forming a transition surface on the ends of the lengths of drill steel reducing the possibility of trapping passing particles of material.

BRIEF DESCRIPTION OF THE DRAWINGS

The invention itself is set forth in the claims appended hereto and forming a part of this specification while and understanding of various embodiments thereof may be had by the reference to the Detailed Description taken in conjunction with the drawings in which:

DETAILED DESCRIPTION

Figures 1, 2, 3, 4, 5, 6, 7:
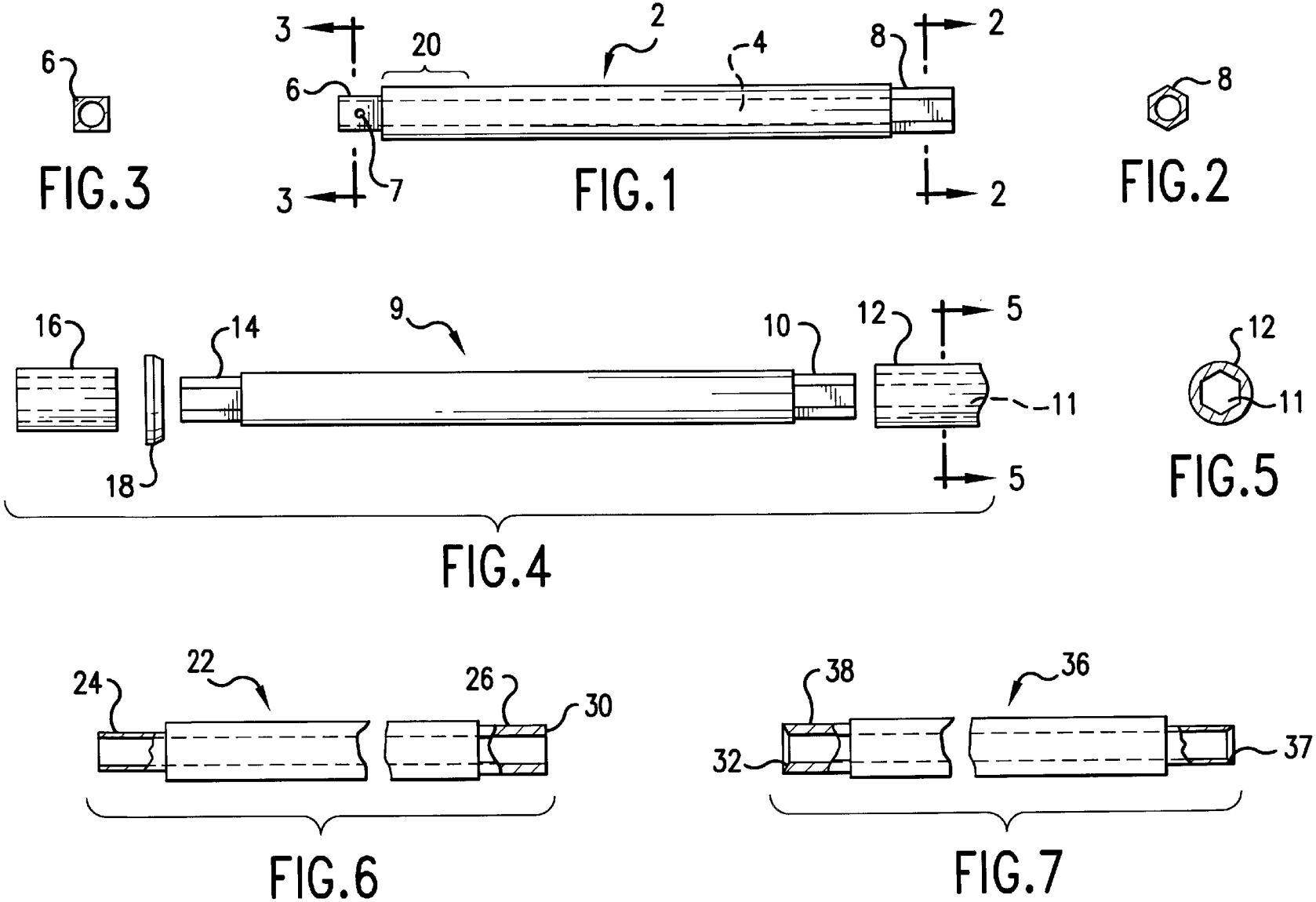
FIG. 1 is a side view partially in section illustrating one embodiment of the invention.
FIGS. 2 and 3 are end views along the lines 2—2 and 3—3 respectively of FIG. 1.
FIG. 4 is an exploded side view of another embodiment of the invention.
FIG. 5 is an end view along the line 5—5 of FIG. 4.
FIG. 6 is a partial side view of the end of a length of drill steel according to the prior art.
FIG. 7 is a partial side view of the end of a length of drill in accordance with this invention.

Referring first to FIG. 1 reference numeral designates generally a length of drill steel in the form of a tube 2 having a hollow passage 4. Formed at one end is a first portion 6 having a hexagonal end. Such a hexagonal end is customarily used to engage a drill bit and may be provided with a hole 7 to engage a retaining clip. Formed at the other end is a second portion having a hexagonal surface 8.

It should be understood the shape of flat surfaces on the end of drill steel is determined by the shape of the element with which it is to be connected and therefore is polygonal, for instance typically square or hexagonal as required. Thus the coupling element may be a socket, wrench, drill chuck or drill bit. Also it may be a collar or a shank permitting coupling to another member. Likewise, whether the flat surface is internal or external depends upon the same considerations. The various connectors, collars and such are provided with surfaces matching the end of the drill steel they are to engage and can be mounted on the steel using press fits.

FIGS. 2 and 3 illustrate the cross section of a drill steel section along the lines 2—2 and 3—3 respectively of FIG. 1.

FIG. 4 illustrates an alternative embodiment of the invention. In this figure the drill steel as an external hexagonal surface 10 at one end. A female connector 12 having an internal hexagonal surface may be pressed on the end 10 to engage another length of drill steel. See FIG. 5 which is a sectional view along the line 5—5 of FIG. 4. Formed at the other end is a hexagonal external end 14 which may when in use engage in complementary tube 16 having a matching hexagonal internal surface and may be press fitted on the end 14 along with a collar 16.

As stated above in the prior art the engaging square or hexagonal surfaces are formed by forging. In this process the portion of the drill steel to be forged is heated to very high temperatures, on the order of 1700 degrees F. and essentially beaten to the desired shape. This process results in a stressed and weakened portion in areas following the forged portion such as indicated by the bracket 20 in FIG. 1.

This invention involves forming the flat surfaces by machining them, that is, the necessary metal is removed from the drill steel which consequently is not distorted by a forging process. This process is carried out using conventional machine tools such as a vertical mill. To facilitate the process special fixtures for advancing the cutting tool and positioning the drill steel for each pass of the cutting tool. Such fixtures however form no part of this invention. The drill steels themselves are heat treated either prior or subsequent to the machining process. It should be understood that the temperatures used to heat treat are not the same magnitude as those used to render the steels malleable for forging.

As the result of this process the drill steel is not weakened in any respect that we have been able to determine. Consequently the possibility of fracture caused by a stressed section is lessened if not eliminated entirely.

The resulting advantage to the industry and the miner have been pointed out above.

Reference is made to FIGS. 6 and 7 of the drawings for a description of another advantageous aspect of the invention. FIG. 6 illustrates a drill steel 22 in accordance with the prior art. Drill steel 22 is shown broken to indicate it may be of any length. It is provided with two ends 24 and 26 having flat surfaces, each shown in cross section. The end 24 is formed as a square internal surface while the end 26 is formed as a hexagonal surface. In the prior art the respective faces 28 and 30 of each of these flat surfaces are at right angles to their lengthwise extensions. Thus as materials from the dust hog flow through the drill steel when in operation these materials may collect around the flat surfaces such as 22 and 24. The build up of these materials can result in blockage of the passage or its' narrowing thereby decreasing the efficiency of the process.

By machining the flat surfaces in accordance with the invention their ends or faces can be chamfered or sloped as shown at 32 and 34 in FIG. 7. In this figure the drill steel 36 is shown as having an exterior hexagonal surface 38 and an interior square surface 40. As the result of this construction no sharp ledges or face such as shown at 28 and 30 in FIG. 6 is presented to obstruct the flow of materials.

It should be understood that the process of machining drill steel can be used on any such devices whether it be a starter, a pusher, a finisher or a driver. Likewise the process can be used on the chucks, adaptors, shanks, couplings and the like, that are formed with square or hexagonal surfaces used with the drill steels.

While various embodiments have been shown and described it is contemplated to claim all embodiments as come within the scope of the claims appended hereto.

What is claimed as new and desired to be secured by Letters of Patent is:

1. A drill steel for use in mine roof bolting operations comprising a length of steel rod having an internal structure and a number flat surfaces forming a polygon at each end for engagement with corresponding flat surfaces on another mine roof bolting element, the improvement whereas: said flat surfaces are formed by removing metal from the ends of said steel rod whereby the internal structure of the steel rod is not altered so that the steel rod is not weakened in a portion of its length in the vicinity of said flat surfaces.

2. A drill steel according to claim 1 wherein said drill steel is constituted by a tubular length of steel having a passage extending there through.

3. A drill steel according to claim 2 wherein the flat surfaces on one end are formed as a square and those on the other end are formed as hexagonal.

4. A drill steel according to claim 3 wherein the flat surfaces on one end of said drill steel are formed on the outer surface of the drill steel and those on the other end are formed on the interior surface of said tubular length of drill steel.

5. A drill steel according to claim 3 wherein the flat surfaces have chamfers at their ends.

6. A drill steel according to claimed 2 wherein said flat surfaces are formed by machining.

7. A drill steel according to claim 6 wherein said drill steel is a heat treated length of steel.

8. A drill steel according to claim 5 wherein said flat surfaces and chamfered ends are machined.

9. Drill steels for mine roof bolting wherein each length of drill steel has an internal structure and flat engaging surfaces at its opposite ends formed as polygons for engaging complementary flat engaging surfaces on another length of drill steel, the improvement wherein said flat engaging surfaces on the drill steels are formed by machining a portion of a length of drill steel at its ends whereby the internal structure of the drill steel is not altered so as that to create an area of weakness in the vicinity of the flat machined surfaces.

10. Drill steels according to claim 9 wherein said lengths of drill steel are tubular having a passage extending there through.

11. The drill steels of claim 10 wherein the passages in said lengths of drill steel are chamfered at their ends.

12. The drill steels of claims 9 wherein said flat engaging surfaces may be on the external surface of the drill steel.

13. The drill steels of claim 10 wherein said flat engaging surfaces may be on the internal surface of the drill steel.

* * * * *